United States Patent [19]

Henze et al.

[11] Patent Number: 5,031,553

[45] Date of Patent: Jul. 16, 1991

[54] METHOD AND ASSEMBLY FOR PRODUCING PROTECTIVE COVERS FOR MATTRESSES INCLUDING: SEWING ELASTIC BANDS, CORNER SEAMS, HEMMING, MEASURING, CONVEYING & POSITIONING FABRIC & HAVING ADJUSTABLE SEWING NEEDLE TRAJECTORIES

[75] Inventors: Siegfried Henze, Hohenroth; Martin Schnaus; Rainer Dippert, both of Bad Königshofen, all of Fed. Rep. of Germany

[73] Assignee: 501 Texpa-Arbter Maschinenbau GmbH, Saal/Saale, Fed. Rep. of Germany

[21] Appl. No.: 395,569

[22] Filed: Aug. 18, 1989

[51] Int. Cl.[5] ..... D05B 33/02; D05B 19/00; D05B 25/00

[52] U.S. Cl. ..... 112/262.1; 112/121.12; 112/121.14; 112/121.26

[58] Field of Search ..... 112/121.12, 121.14, 112/121.26, 262.1

[56] References Cited

U.S. PATENT DOCUMENTS

| | | | |
|---|---|---|---|
| 4,271,774 | 6/1981 | Burton | 112/262.1 |
| 4,292,908 | 10/1981 | Blessing | 112/121.12 X |
| 4,512,269 | 4/1985 | Bowditch | 112/121.14 X |
| 4,594,956 | 6/1986 | Vartoukian | 112/262.1 |
| 4,607,582 | 8/1986 | Brocklehurst | 112/121.12 |
| 4,682,555 | 7/1987 | Bierbaum | 112/121.26 X |
| 4,748,922 | 6/1988 | Bierbaum | 112/121.12 |
| 4,785,750 | 11/1988 | Best . | |

*Primary Examiner*—Werner H. Schroeder
*Assistant Examiner*—Ismael Izaguirre
*Attorney, Agent, or Firm*—Laubscher, Presta & Laubscher

[57] ABSTRACT

With a method for completely automatic products of fitted sheets, elastic bands are sewn into or onto the cut edges (transverse edges), and the lengths of the elastic bands correspond approximately to the widths of the pieces of fabric. Then the widths of the pieces of fabric are measured and, dependent upon the results of this measurement, a piece of fabric is positioned in the middle or symmetrically in relation to the sewing needles of four sewing devices for formation of the corner seams, and the needles are provided in pairs facing each cut edge (transverse edge) of a piece of fabric at a corner processing station. Thereafter, the piece of fabric is hemmed in the corner of processing station parallel to its cut edges (transverse edges) and the hems of the piece of fabric are fixed. The longitudinal edges of the piece of fabric positioned in the corner processing station are then scanned, and dependent upon the scanning, the alignment of the sewing trajectories of the sewing assemblies occurs for the formation of corner seams at the points of intersection of the elastic bands or cut edges with the longitudinal edges of each relevant piece of fabric. Finally, corner seams are formed along the predetermined sewing trajectories and the excess corners of the piece of fabric and excess ends of the elastic bands are separated and removed adjacent to each corner seam.

15 Claims, 13 Drawing Sheets

METHOD AND ASSEMBLY FOR PRODUCING PROTECTIVE COVERS FOR MATTRESSES INCLUDING: SEWING ELASTIC BANDS, CORNER SEAMS, HEMMING, MEASURING, CONVEYING & POSITIONING FABRIC & HAVING ADJUSTABLE SEWING NEEDLE TRAJECTORIES

BACKGROUND OF THE INVENTION

The invention relates to a method for the production of fitted sheets or similar protective covers for the mattresses of beds or the like, in which rectangular pieces of fabric are cut from a strip of cloth and then elastic bands are sewn onto or into the facing cut edges (transverse edges) of the pieces of fabric, wherein the length of the elastic band corresponds approximately to the width of the piece of fabric, and the corner seams are then formed on the fitted sheets and excess corners of fabric are then separated off. The invention also relates to a sewing assembly for execution of the above method.

A method for the production of fitted sheets or similar protective covers as well as a device for execution of such a method are already known from U.S. Pat. Nos. 4,682,555 and 4,748,922. This known device however represents only a semiautomatic sewing assembly for fitted sheets, in which the elastic bands are simply sewn into the individual pieces of fabric. The formation of the corner stitches forming seams on the fitted sheets as well as the separation of excess corner pieces of fabric in this case is still executed manually, and at an additional work station. Furthermore, it is known that the width of the strip of fabric from which rectangular pieces of fabric are separated off for the production of the fitted sheets is subjected according to production conditions to slight variations of dimensions and boundary lines. In the above known method for the production of fitted sheets, the different widths of incoming material strips have been calculated so that the suitable correction of the adaptation of dimensions has been undertaken with the sewing down of the corners of the fitted sheets or with the manual production of corner seams, wherein the operator has placed the diagonal folds of each corner of a piece of fabric flush with the corners of two adjacent edges of pieces of fabric.

SUMMARY OF THE INVENTION

The object of the invention is to disclose a method as well as a sewing assembly for completely automatic production of fitted sheets or similar protective coverings, in which nonstandard widths of the strip of material are to be compensated rapidly and automatically, in order without any further problem to produce properly formed corners or corner seams on the fitted sheets.

The above object is attained by a method as disclosed in Patent Claim 1. The method of Patent Claim 1 is characterized by the following method features:

(a) measurement of the width of the pieces of fabric or the strip of cloth, (b) dependent upon the results of the above measurement, as disclosed in feature (a), positioning in sequence of pieces of fabric in the middle of the assembly or centered in relation to two sewing needles of sewing devices for formation of the corner seams adjacent to each cut edge of the piece of fabric, (c) hemming or folding of the piece of fabric parallel to its cut edges and fixation of the hemmed or folded parts of the pieces of fabric, (d) systematic adjustment of the reciprocal spacing of the two sewing needles of the sewing devices for formation of the corner seams on each outside edge of the hem of the piece of fabric at approximately the width of a bed mattress, (e) scanning of the two lengthwise edges of the already positioned pieces of fabric and, dependent upon said scanning, alignment of the sewing trajectories of the sewing needles of the sewing device to form the corner seams at the points of intersection of the elastic bands or the cut edges with the lengthwise edges of the piece of fabric, and (f) formation of the corner seams along the predetermined sewing trajectories and separation of the excess corners of fabric adjacent to each corner seam.

By use of the method with the above features according to the invention, fitted sheets can be produced fully automatically with corners (corner seams) formed without any difficulties of adaptation to the varying widths of strips of material. It is thus especially essential to the invention that the widths of the individual pieces of fabric or the width of the strip of fabric be measured continuously, and dependent upon the results of this measurement, each piece of fabric is aligned in the middle of the assembly or aligned centrally to the sewing needles of the sewing devices for formation of the corner seams. As a result of scanning of the lengthwise edges of each piece of fabric which is positioned in this manner, it is then possible and advantageous to set the sewing trajectories of the sewing devices for formation of the corner seams so that clean corner seams can be produced with different widths of the pieces of fabric or of the strip of material without any further difficulty.

Different embodiments of the method according to the invention proceed from the dependent claims. The economic feasibility of the method is enhanced by the features of Claim 2, since only a short time is required for the fine setting of the sewing trajectories of the sewing devices for formation of the corner seams.

The features of Claim 3 further enhance the economic feasibility of the method according to the invention, because the measurement of the widths of the pieces of fabric occurs during conveyance of the pieces of fabric.

The features of Claim 4 provide the advantage that the method according to the invention can be executed in a small space.

A sewing assembly for execution of the method of Claim 1 is disclosed in Claim 5. This sewing assembly is characterized according to the invention by the following features:

(a) a first conveyor device to convey rectangular pieces of fabric cut from a strip of material, which conveys the piece of fabric to an interim station transverse to its lengthwise dimension of elasticity or parallel to its two cut edges, (b) feed devices for elastic bands or the like facing the two cut edges of the pieces of fabric in the area of the first conveyor device, which guide the elastic bands in stretched-out state parallel to the two cut edges of each pieces of fabric until they engage the cut edges, (c) two sewing machines in the area of the first conveyor device for the permanent stitching-in of the elastic bands parallel to the edges of the sheets while under tension, sewing them to the pieces of fabric with formation of extending fragments of elastic band on each lengthwise edge of the pieces of fabric, (d) a second conveyor device at the interim station, which picks up the pieces of fabric from the first conveyor device, (e) a third conveyor device, which picks up the pieces of fabric from the second conveyor at the interim station and conveys them to a corner processing station, (f) a measuring device to measure the widths of the pieces of fabric, which controls the third conveyor device so that this conveyor device acts to position each piece of fabric centrally in the corner processing station, (g) two sewing assemblies at the corner processing station adjacent to each cut edge of a pieces of fabric, the sewing assemblies arranged power-rotatable or power-adjustable around the axes of their sewing needles and their sewing machine assemblies can be moved in the sewing trajectory, (h) devices at the corner processing station for the formation of two hems on each piece of fabric parallel to its cut edges, (i) holding devices at the corner processing station to hold the extending ends of the elastic bands on the hems of each piece of fabric, which holding devices pick up these extending ends of the elastic bands from the third conveyor device, (j) scanning and control devices at the corner processing station, which scan and sense the lengthwise edges of each piece of fabric and control the rotary movements of adjustment and for setting of the sewing devices in such a manner that their sewing trajectories at the points of intersection of the elastic bands or cut edges are aligned with the lengthwise edges of each of the pieces of fabric, and the reciprocal spacing of the sewing needles of each of the two sewing assemblies in their starting positions at the outside edges of the hems of each one of the pieces of fabric is adjustable approximately to the width of a bed mattress, (k) separating devices at the corner processing station for the cutting of excess fabric corners from the fitted sheets, and (l) a fourth conveyor device to carry the completed fitted sheets away from the corner processing station.

The separating devices at the corner processing station for the purpose of cutting off excess fabric corners on the fitted sheets are preferably coupled with the sewing assemblies, so that the four corner seams and the separating cut pertaining to each fitted sheet can all be executed practically simultaneously.

The construction of the sewing assembly according to Claim 6 provides the advantage that the third conveyor device is provided with clamp carriers which can pass each piece of fabric in stretched-out state into the corner processing station, so that the width of each of the individual pieces of fabric can be measured during this process of conveyance.

Further exemplary constructions of the clamp carriers of the third conveyor device as well as the holding devices for the extending ends of the elastic bands as disclosed in Claim 7.

The further configuration of the sewing assembly according to Claim 8 provides the advantage of an even greater enhancement of the high production rate, since the measurement of the width of the pieces of fabric can be carried out while these pieces of fabric are being transported in stretched-out state from the interim station to the corner processing station.

Still another configuration of the invention is provided in that at least two of the four sewing assemblies can be adjusted to be parallel to the conveyor device conveying the pieces of material. This allows for a rough setting of the sewing assemblies to significant differences in the widths of the pieces of fabric or the strip of material. Also, different widths of bed mattresses for which the fitted sheets are intended can thus be considered.

The further configuration of the invention according to Claim 10 provides the advantage of a structural simplification of the sewing assemblies and a simple layout for execution of the rotary setting or adjustment movements.

One especially advantageous type of transfer of the extending ends of the elastic bands from the clamp carriers of the third conveyor device onto the pairs of holding digits is disclosed in Claim 12.

The further configuration of the invention according to Claim 13 provides the advantage that the sewing assembly can be constructed compactly in the area of the corner processing station, because the conveyor assembly for the interception and sideways conveyance of the completed fitted sheets is located directly beneath the corner processing station.

BRIEF DESCRIPTION OF THE DRAWINGS

The invention is to be described hereinafter relative to the drawings of one exemplary embodiment. In the drawings.

Figure 2:
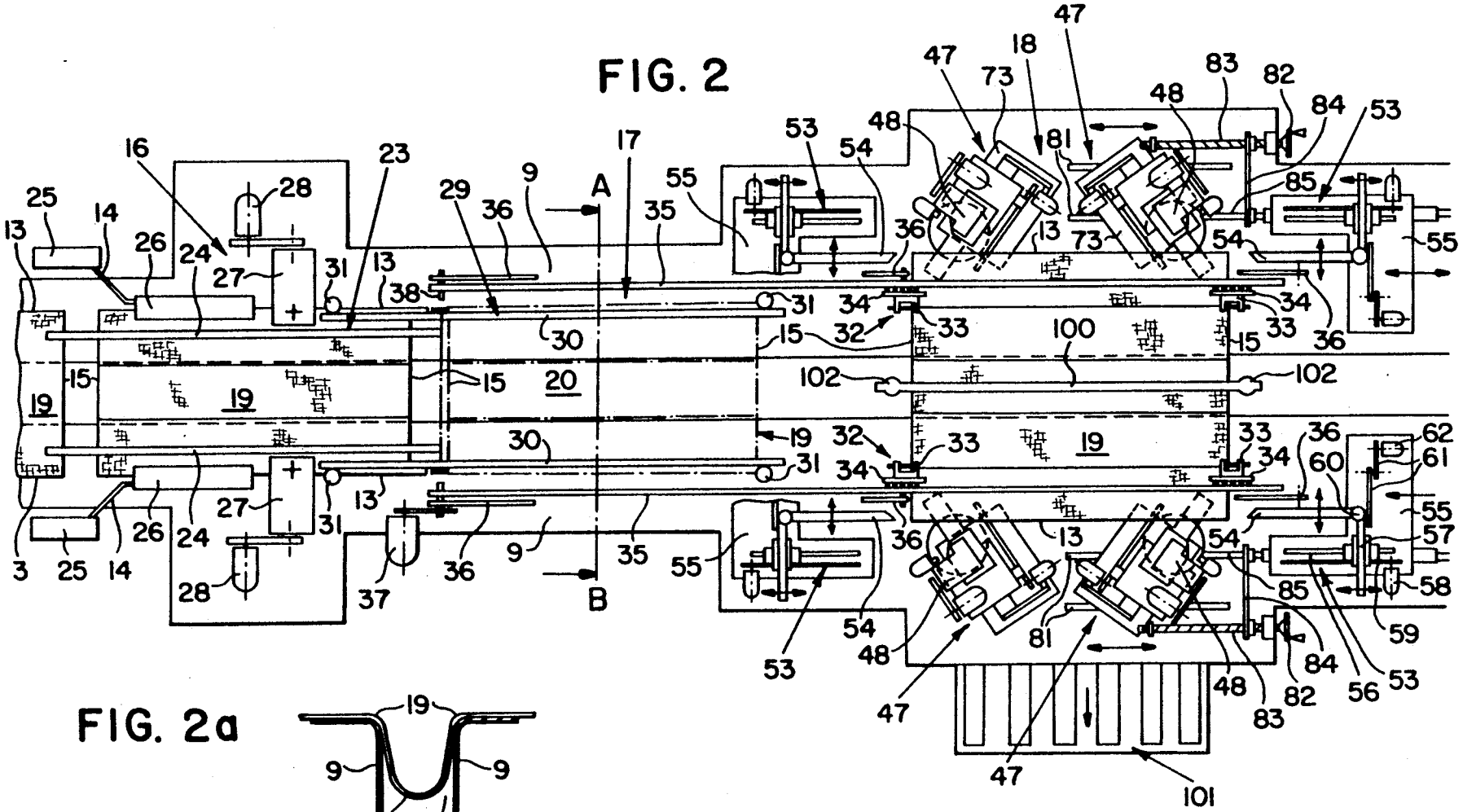
FIG. 2 shows a diagrammatic plan view of a sewing assembly for completely automatic production of fitted sheets.
Figure 3:
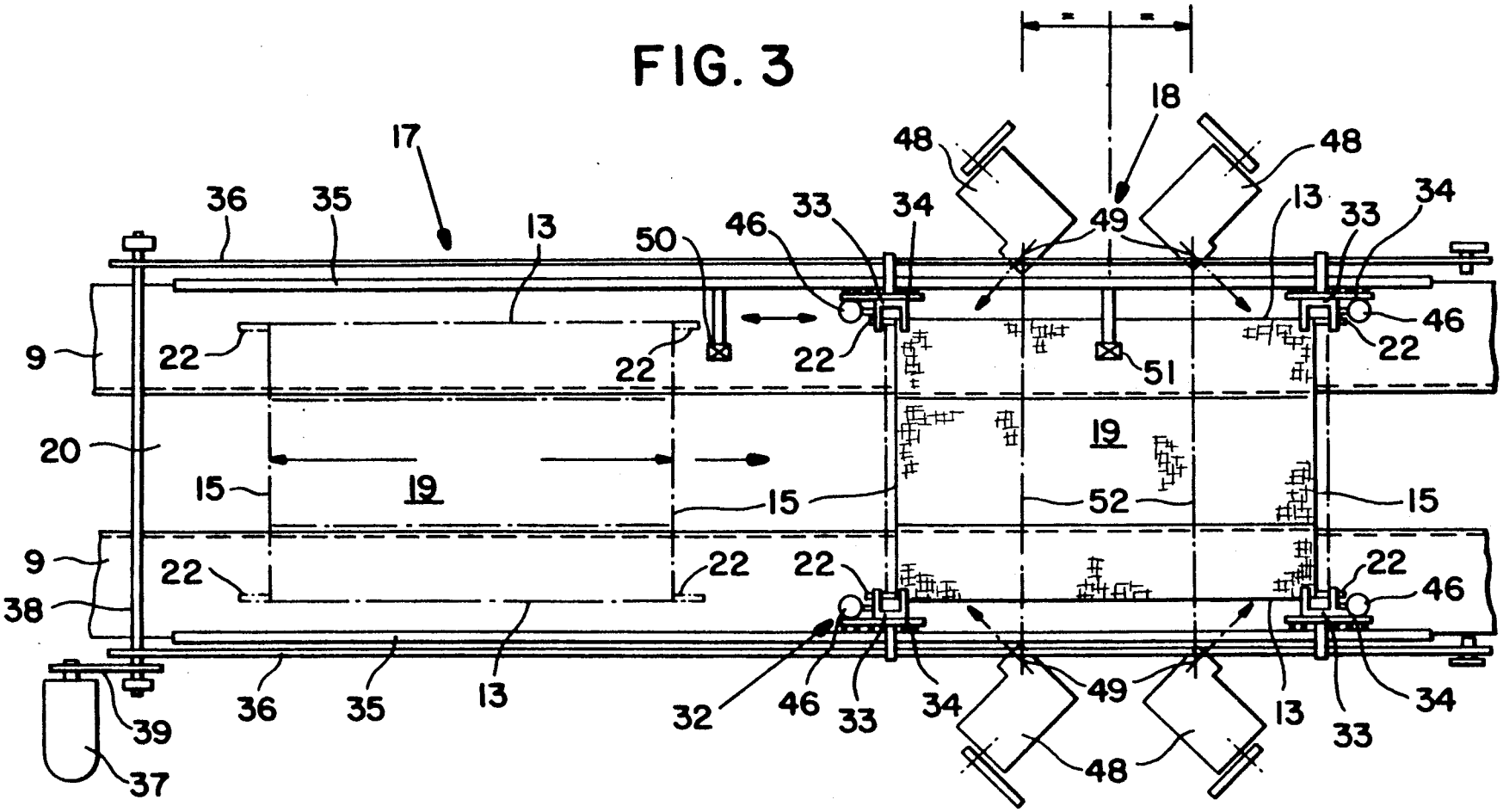
Figure 4:
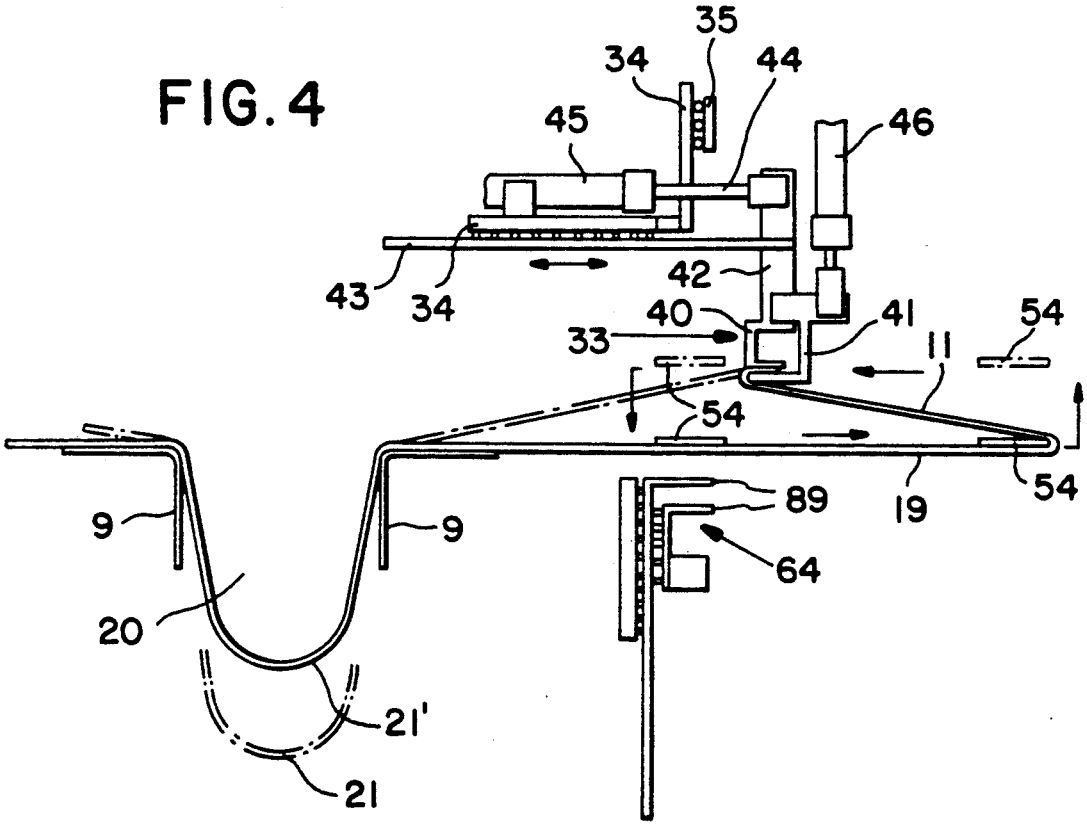
Figure 5:
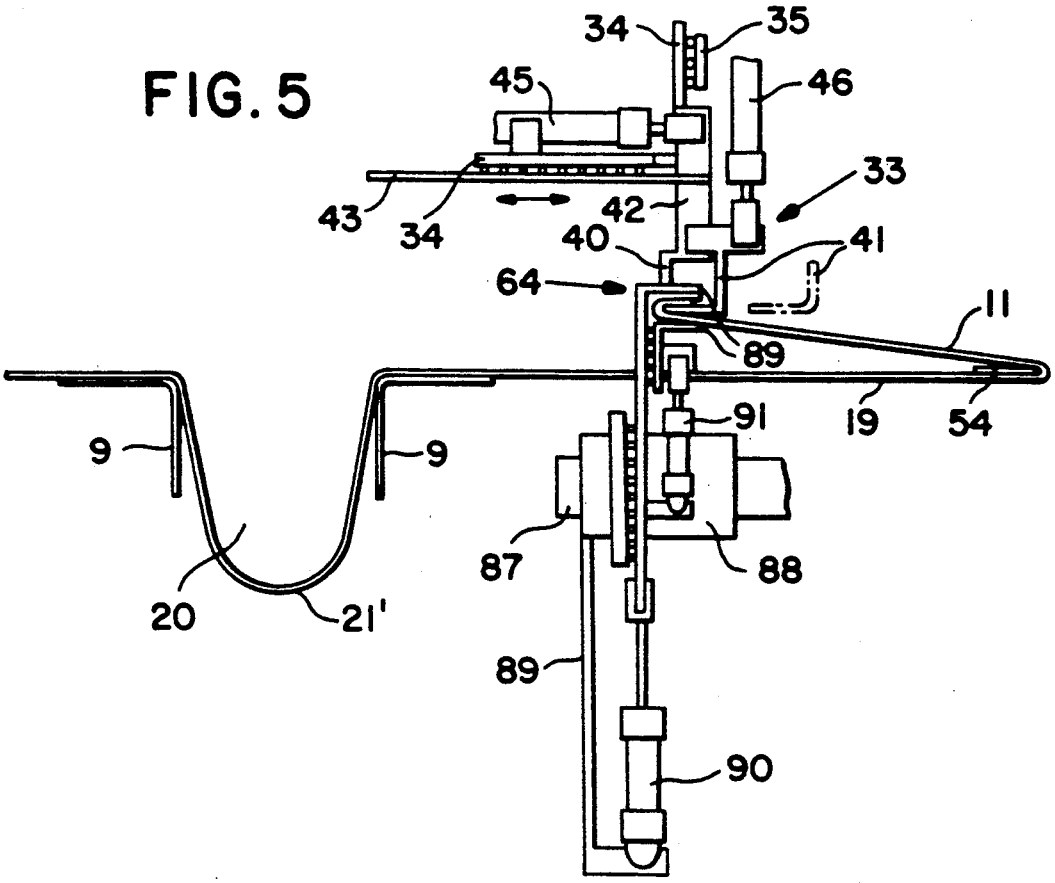
Figure 6:
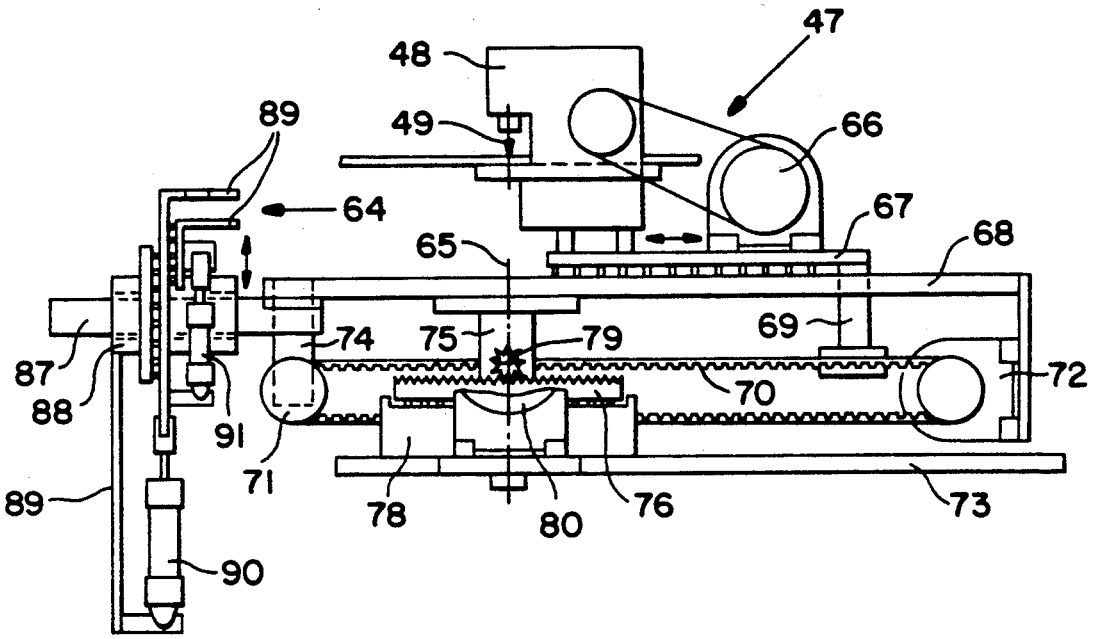
Figure 7:
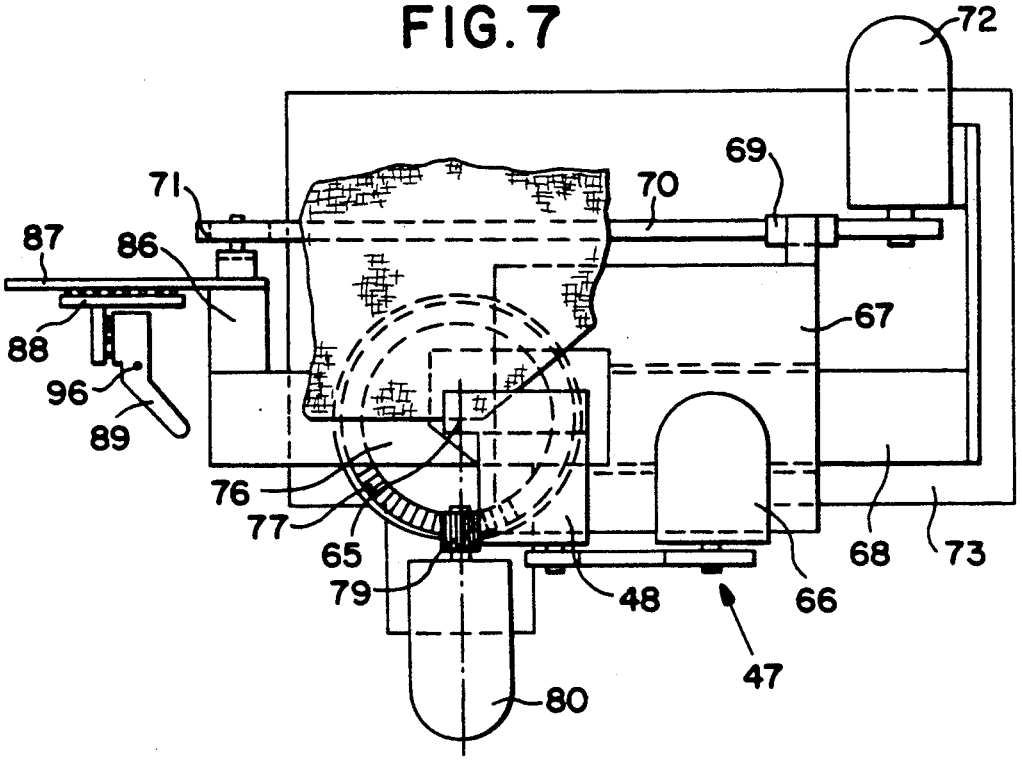
Figure 16:
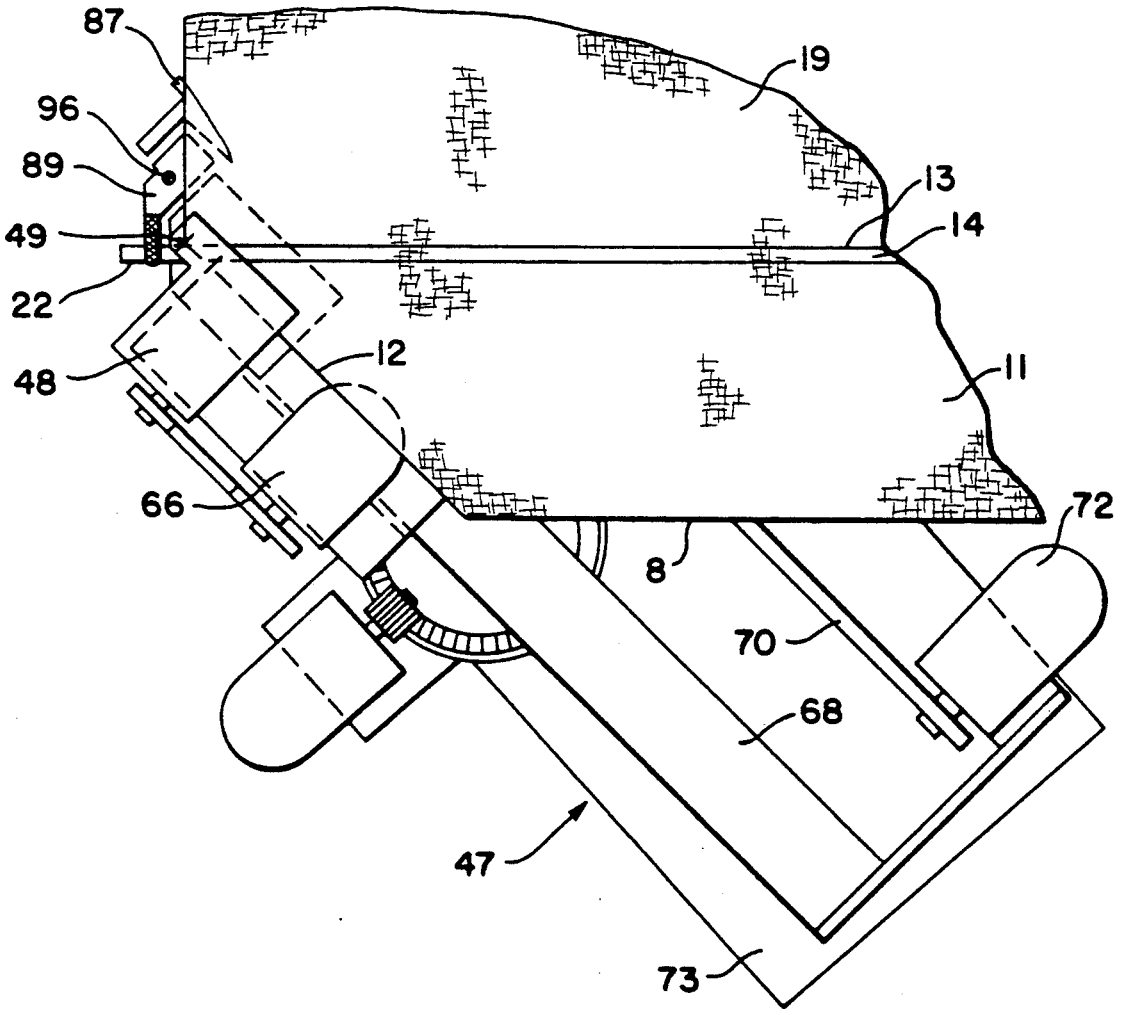
Figure 17:
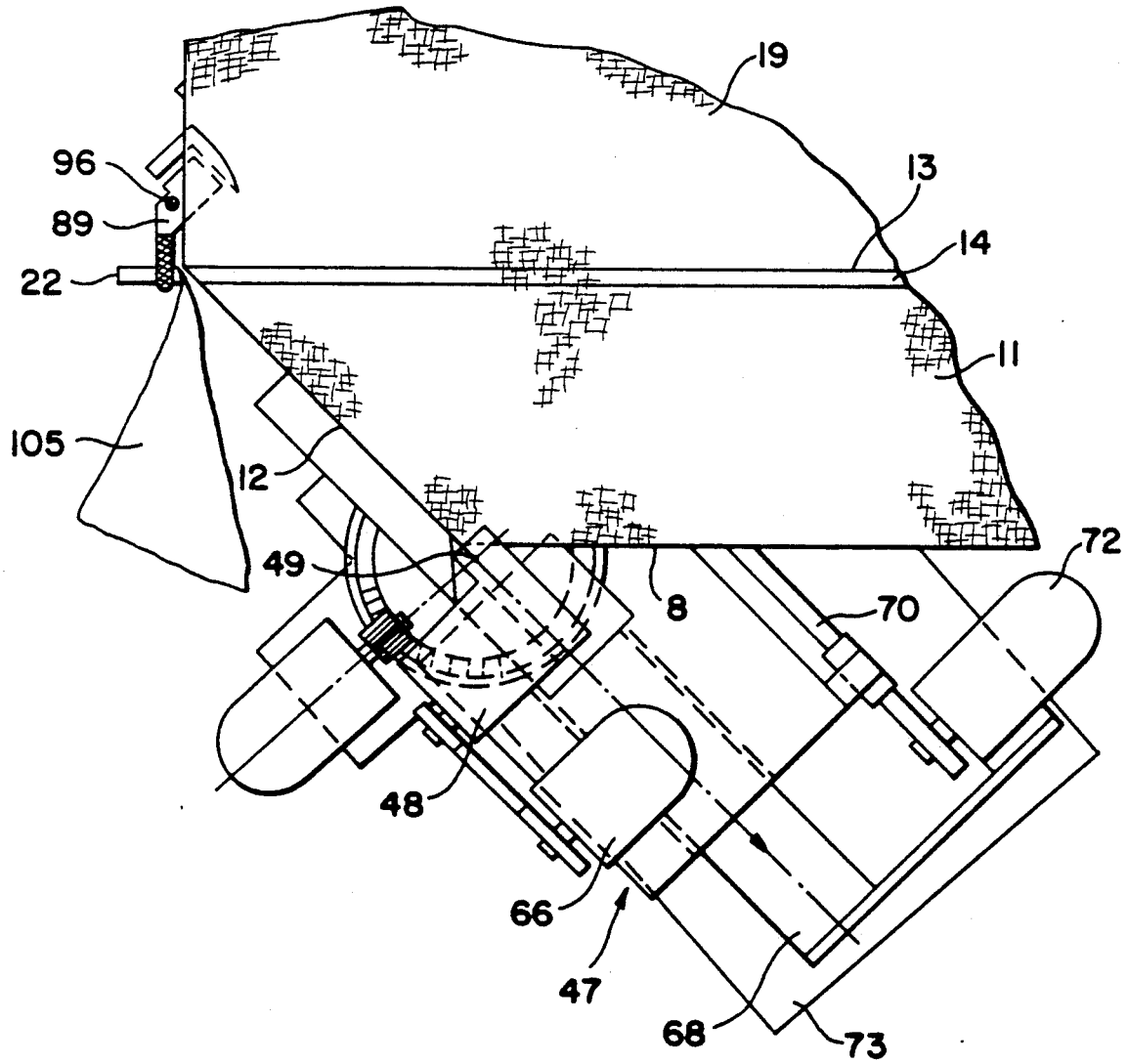
Figure 18:
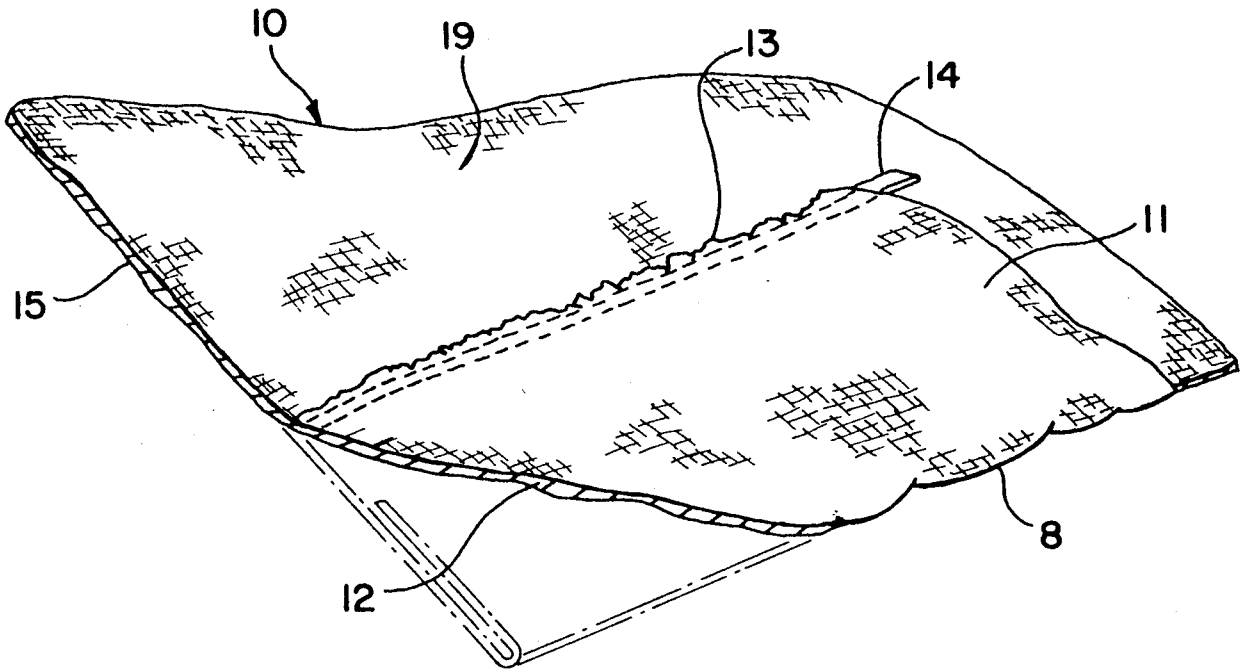

FIG. **2-*a* shows a cross sectional view along line A-B of FIG. 2**, but only from the machine table of the sewing assembly with a middle passage and a piece of fabric engaging on the machine table, said piece of fabric extending with a fold in the passage;

FIG. 3 shows a plan view of a part of the sewing assembly of FIG. 2, in which in this case only those portions of the assembly are shown which are required for central positioning of a piece of fabric in a corner processing station of the sewing assembly;

FIGS. 4 and 5 each show a partial transverse cross-sectional view of the sewing assembly, but each shows only some of the devices for holding and hemming or folding of a piece of fabric at one of its two cut edges;

FIG. 6 shows a diagrammatic side view of one of the four sewing devices shown in FIG. 2 for production of the corner seams on the fitted sheets;

FIG. 7 shows a plan view of the sewing device shown in FIG. 6;

FIGS. 8–17 show various work phases in the formation of a hem on one of the two shorter sides of a rectangular piece of fabric as well as during the production of one of four corner seams for the production of a fitted sheet, and FIG. 18 shows an oblique view of a corner area of a fitted sheet with a corner seam produced in the sewing assembly according to the invention and as shown in FIG. 2.

DESCRIPTION OF THE PREFERRED EMBODIMENTS

Figure 1C:
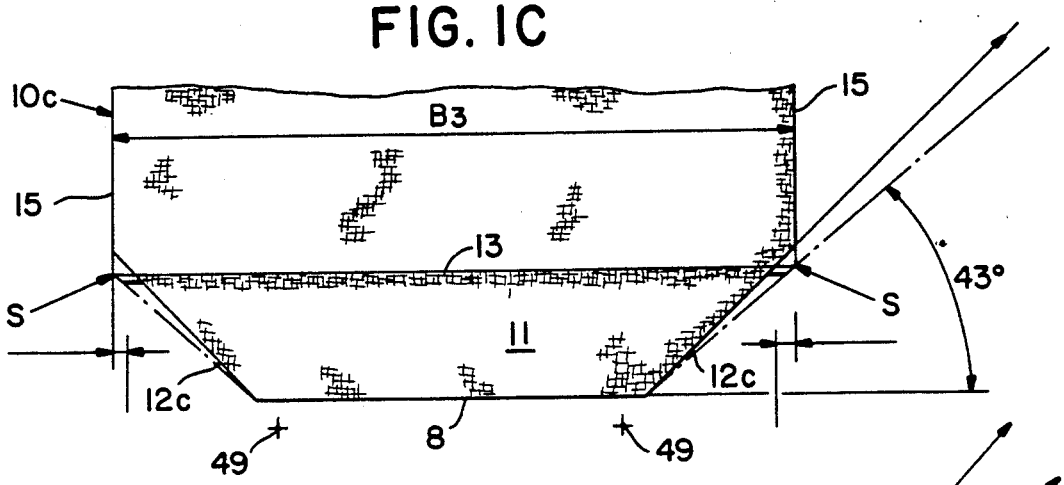
FIGS. 1A–1C each show a plan view of end segments of three fitted sheets made up of pieces of fabric of different widths and corner seams formed at identical angles of 45° to the shorter sides of the fitted sheets.
Figure 1B:
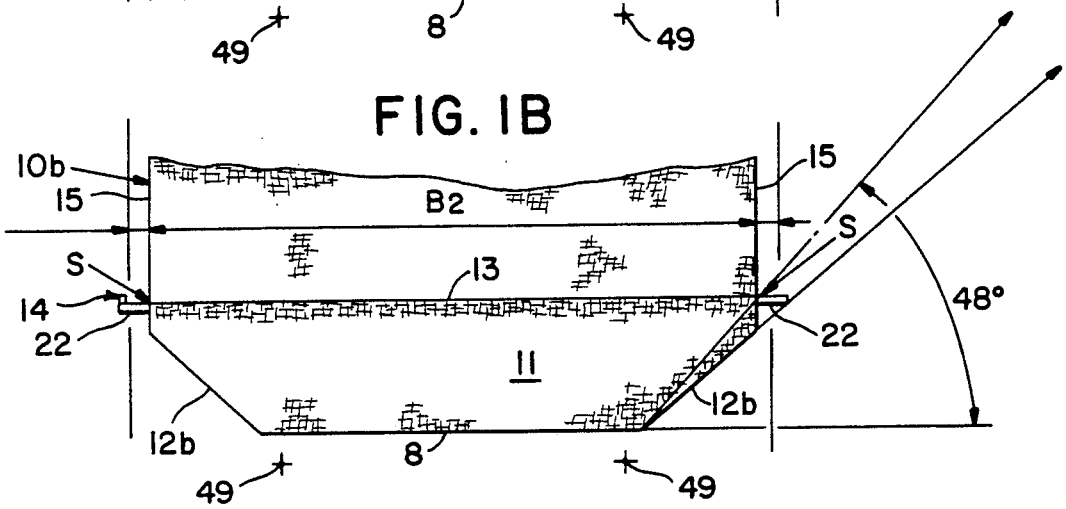
Figure 1A:
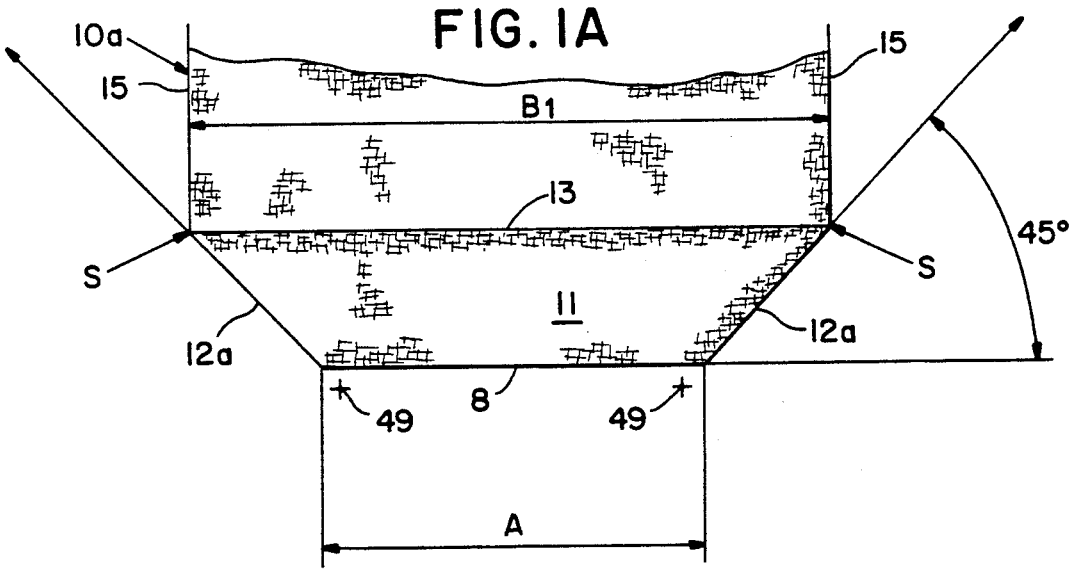

In FIGS. 1A–1C, one end segment of fitted sheets **10*a*, 10*b* and 10*c* is shown in each drawing. Fitted sheets 10*a*–10*c* are shown with hems 11 and corner seams 12*a***, 12*b* and 12*c* on both ends or respectively both shorter sides. The starting material for fitted sheets 10*a*–10*c* may be a strip of material from which are separated rectangular pieces of fabric of identical length, as is described for instance in U.S. Pat. No. 4,748,922. The widths of the strip of material can deviate from article to article for different finished article requirements, and therefore the widths $B_1$, $B_2$ and $B_3$ of the pieces of fabric from which the fitted sheets 10*a*, 10*b* and 10*c* are to be manufactured are also different. While fitted sheet 10*a* is produced from a piece of fabric with a predetermined standard width $B_1$, the fitted sheets 10*b* and 10*c* are manufactured from pieces of fabric with somewhat smaller width $B_2$ and somewhat greater width $B_3$ respectively. If now inadvertently the different widths $B_1$–$B_3$ of the starting material pieces of fabric for the fitted sheets 10*a*–10*c* are fixedly or rigidly placed in the sewing trajectories of sewing needles 49 for the process of forming the corner seams 12*a*–12*c*, for instance at an angle of 45° to the outside edges 8 of hems 11 of the pieces of fabric, then this will result in the unsatisfactory corner seams 12*b* and 12*c*, shown in FIGS. 1B and 1C. In both of these cases, the corner seams 12*b* and 12*c* do not run along, as desired and as shown in FIG. 1A, as far as the intersecting points S between the transverse or cut edges 13, which in this case include in them the elastic bands 14, and lengthwise edges 15 of fitted sheets 10*b* and 10*c*. Fitted sheets 10*b* and 10*c* are therefore defective. With the sewing assembly according to the invention, which is to be described hereinafter, then, even with different widths of strips of material or respectively different widths of the starting material, pieces of fabric for the fitted sheets are produced simply and without difficulty, in other words correct alignment of the corner seams 12 in FIGS. 17 and 18 is attained.

The sewing assembly shown in FIG. 2 has a sewing station 16 for the sewing of elastic bands 14 into both transverse and cut edges 13 of each one of the pieces of fabric 19, an interim station 17, and also a corner processing station 18, whereby these stations 16, 17 and 18 are arranged in sequence in the direction of conveyance of pieces of fabric 19 one after the other on a machine table 9. The pieces of fabric 19, from which are produced the fitted sheets 10 (FIG. 18), are, as already described, cut away from a strip of material in identical lengths and are fed by a not shown conveyor device from the sewing assembly (FIG. 2) on the left onto machine table 9. Thus both of the cut edges 13 of each one of the rectangular pieces of fabric 19 extend parallel to their direction of conveyance into the sewing assembly. Machine table 9 has a passage 20 in the middle and in the direction of conveyance of pieces of fabric 19, and said passage engages and picks up the folded part 21 of each piece of fabric 19. The direction of conveyance of pieces of fabric 19 is indicated in FIG. 2 by an arrow in passage 20 and it is to be noted that pieces of fabric 19 are conveyed through the sewing assembly with their longitudinal edges 15 lying transverse to the direction of conveyance.

Figure 2A:
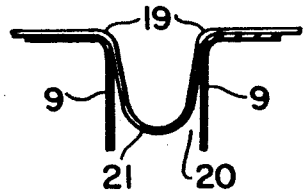
Figure 8:
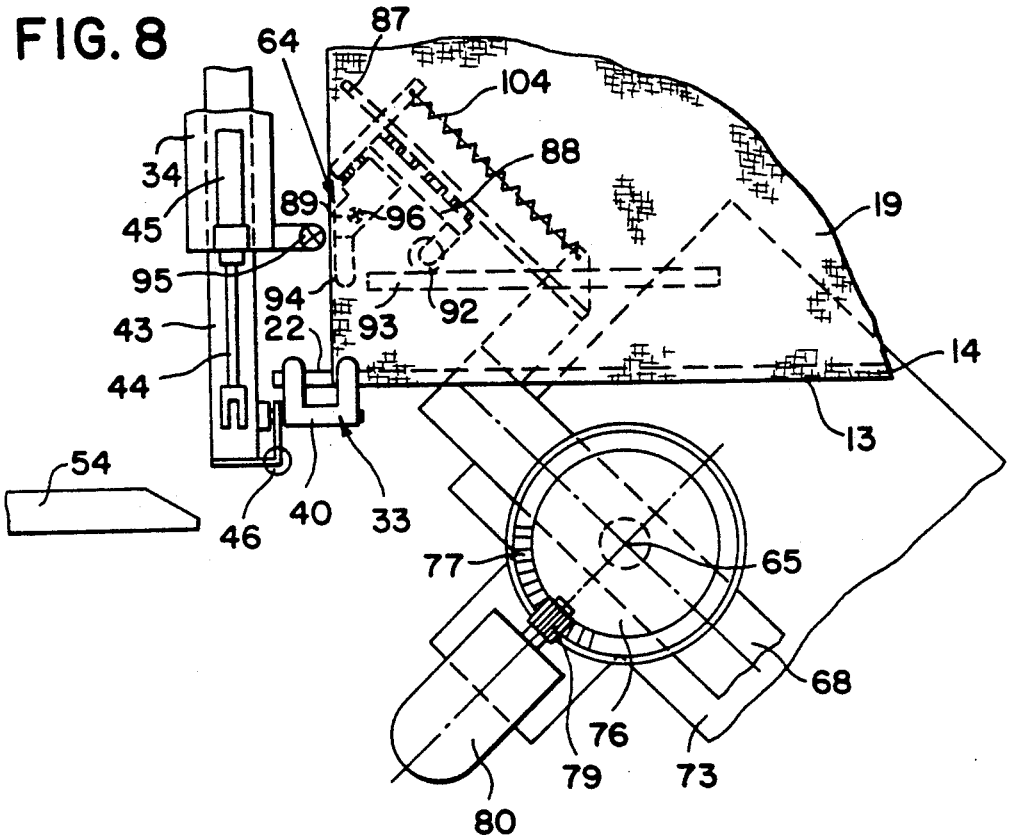

A first conveyor device 23 is provided at sewing station 16 for the elastic bands 14 which are intended for pieces of fabric 19, and the conveyor may for instance consist of two endless, motor-powered conveyor belts 24. The bottom end segments of conveyor belt 24 hold pieces of fabric 19 until they engage machine table 9, and indeed said segments hold the pieces of fabric flattened out at both of their edge areas (FIG. 2*a*). Feed devices 25 and 26 feed elastic bands 14 opposite both of the cut edges 13 of pieces of fabric 19. These devices 25, 26 feed elastic bands 14 in stretch-out state parallel to both of the cut edges 13 of the pieces of fabric 19, and in devices 26 there is also provided a folding element, which can hem the cut edges 13, so that elastic bands 14 in stretched-out state can be sewn into these hems by the sewing machines 27. Sewing machines 27 are powered by their own drive motors 28. The aforementioned and described devices 25, 26 and sewing machines 27 for the introduction and sewing of elastic bands 14 into pieces of fabric 19 could be configured as these members are configured in U.S. Pat. No. 4,748,922. It is also to be noted that the sewing of elastic bands 14 into pieces of fabric 19 occurs in such a manner that at both longitudinal edges 15 of each piece of fabric 19, the ends 22 of elastic bands 14 extend outward (FIG. 8). The purpose of the extending ends 22 is to be explained hereinafter.

The first conveyor device 23 conveys pieces of fabric 19 to interim station 17 following the sewing in of elastic bands 14. A second conveyor device 29 is provided at interim station 17, and the second conveyor device may consist of two motor-powered, endless conveyor belts 30, which can be moved up and down by four lifting cylinders 31. In their bottom position, conveyor belts 30, which extend beyond conveyor belts 24 of the first conveyor device 23 at the sides, pick up the pieces of fabric 19 from first conveyor device 23.

A third conveyor device 32 picks up pieces of fabric 19 from the second conveyor device 29 at interim station 17 and conveys pieces of fabric 19 to corner processing station 18. This third conveyor device 32 has four clamp carriers 33 to pick up pieces of fabric 19, which clamp carriers can be moved back and forth in pairs by means of carriage 34 along guide rails 35 parallel to the direction of conveyance of pieces of fabric 19. For this purpose, each two carriages 34 are fastened to an endless cog belt or a drive chain 36. The two drive chains 36 are powered through a common shaft 38 coming from drive motor 37, which can be driven in both directions of rotation. The common drive shaft 38 supports the not shown drive chain wheels for the two drive chains 36. Drive shaft 38 remains in drive connection with the motor 37 through another endless drive chain 39 (FIG. 3).

Only one of the four clamp carriers 33 which are configured to be identical to one another is to be described hereinafter.

Each clamp carrier 33 has two clamp parts 40 and 41 (FIGS. 4, 5 and 8), which are configured as U-shaped when viewed from above. Clamp part 40 is connected by a holder 42 with a guide rail 43 which is movably mounted on carriage 34 to move crosswise to the direction of conveyance of pieces of fabric 19 or respectively parallel to their longitudinal edges 15. Furthermore, holder 42 is connected with the piston rod 44 (FIG. 4) of an operating cylinder 45 which may be pneumatically operated, the cylinder fastened to carriage 34. Furthermore, the second clamp part 41 is also mounted on holder 42 in such a manner as to be rotary movable. Clamp part 41 can be pivoted by an operating cylinder 46, which may be pneumatic, in order to open or close clamp carrier 33. Operating cylinder 46 is fastened to guide rail 43. From the above explanation, it is obvious that the four clamp carriers 33 can also be moved back and forth transverse to the direction of conveyance of pieces of fabric 19 and this is true based on the information which is to be disclosed and explained hereinafter.

As already described, the third conveyor device 32 picks up each piece of material 19 from second conveyor device 29 at interim station 17. The four clamp carriers 33 of third conveyor device 32 for this purpose are moved from corner processing station 18 of FIGS. 2 and 3 to the left into interim station 17. In this station 17, the four clamp carriers 33 grasp the relevant piece of material 19 at its four corners and also at the projecting ends 22 of elastic bands 14. Conveyor belts 30 of second conveyor device 29 are then raised and the third conveyor device 32 with the four clamp carriers 33 conveys piece of material 19 into corner processing station 18. Thus the clamp carriers 33 hold piece of material 19 in the area of its two cut edges 13 in stretched-out state. This is important for measurement of the widths of pieces of material 19, a step which is still to be described.

Figure 15:
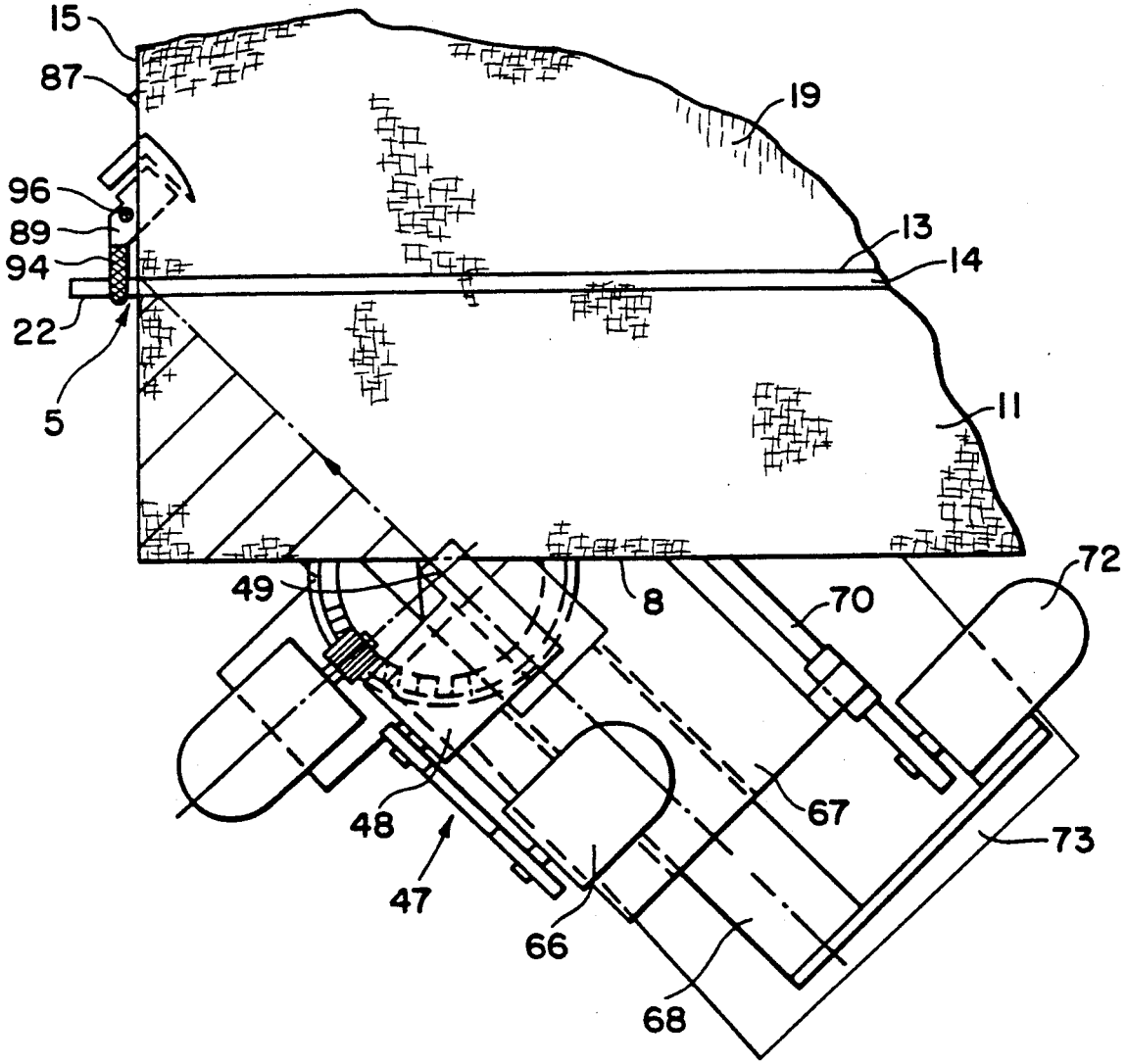

Four sewing assemblies 47 for the sewing the corner seams 12 (FIG. 18) are arranged at the corner processing station 18 (FIG. 2) on machine table 9 and indeed two of said assemblies face each cut edge 13 of each piece of fabric 19. Each sewing assembly 47 includes a sewing machine 48 with a sewing needle 49. A piece of fabric 19 is fed into corner processing station 18 according to the results from a subsequently described measuring device which is controlled so that the relevant piece of fabric 19 is positioned in the middle or centrally in station 18 and symmetrical to sewing needles 49 of each two sewing machines 48 opposite each cut edge 13 of pieces of fabric 19. It is also to be noted that the four sewing assemblies 47 are arranged symmetrically in corner processing station 18 and the sewing machines 48 in this phase are located in their starting positions (FIGS. 2, 3 and 15).

The aforementioned measuring device, which controls the third conveyor device 32 for the described positioning of each piece of fabric 19 in corner processing station 18, has two measuring members 50, 51. The one measuring member 50 is arranged between interim station 17 and corner processing station 18 and measures the width of each of the pieces of fabric 19, while said piece of fabric is being transported past on measuring member 50 into corner processing station 18. The other measuring member 51 is arranged at corner processing station 18 in the middle between connecting lines 52 of sewing needles 49 of each two sewing assemblies 47 arranged facing one another and aligned transverse to the direction of conveyance of the piece of fabric. The second measuring member 51 acts on each piece of fabric 19 being conveyed into corner processing station 18, and it senses and scans the moving front edge 15 of each of these. Furthermore, second measuring member 51 is electrically connected with measuring member 50, and it includes circuitry which halves the measurement results of first measuring member 50. Second measuring member 51, dependent upon the halved measurement results, then controls the third conveyor device 32 in the already described manner so that each piece of fabric 19 is positioned in the middle of station 18 or is positioned symmetrically to sewing needles 49 of the four sewing assemblies 47 or sewing machines 48. In this case it has to do with a first measure for the compensation of different widths of pieces of material 19 or of varying widths of the same strip of material, from which pieces of material 19 are separated, in order to be able to produce corner seams 12 on fitted sheets 10 without difficulty (FIG. 18). The other required measurements for this purpose are described hereinafter in connection with FIGS. 6–17.

Before the four corner seams 12 are formed in corner processing station 18 on a fitted sheet 10 (FIG. 18), the piece of fabric 19 is hemmed or folded parallel to its cut edges 13 in corner processing station 18, in other words, two hems 11 are formed therein.

Figure 11:
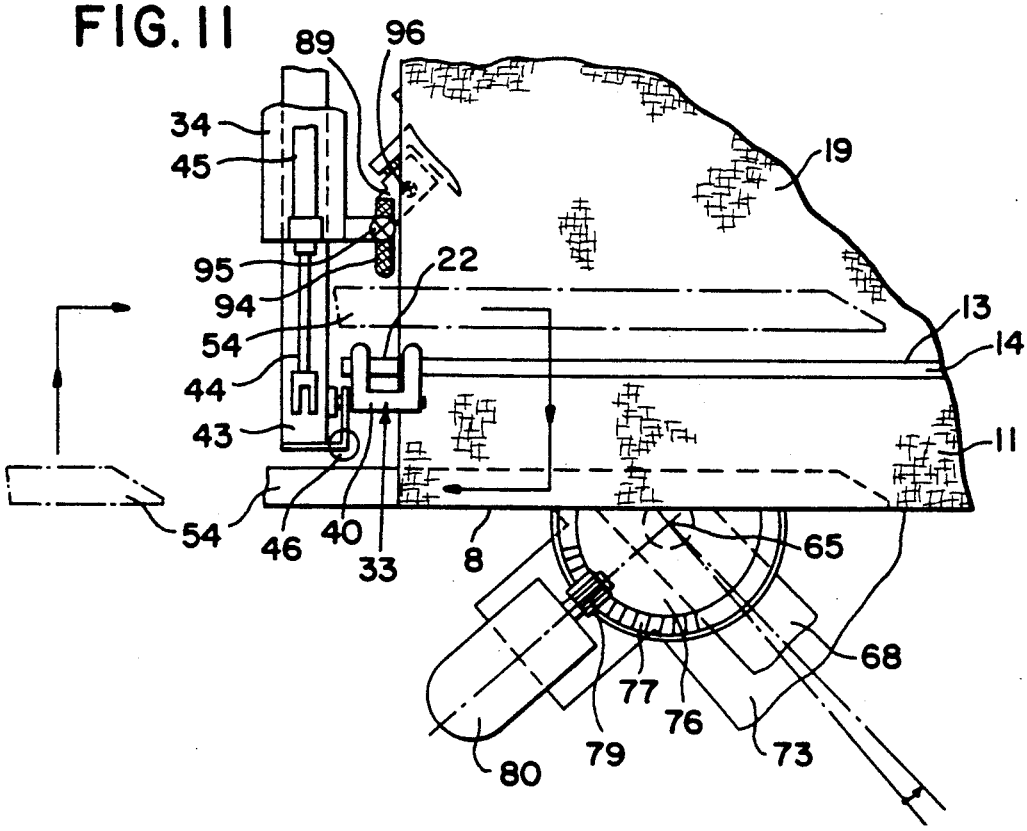

Each piece of fabric 19 is hemmed parallel to its cut edges 13, while it is being held in stretched-out state by clamp carriers 33 parallel to the direction of conveyance. Four folding devices 53 mounted on machine table 9 serve to form the two desired hems 11, each folding device having a folding tongue 54. Folding tongues 54 are movable back and forth transverse to the direction of conveyance of piece of fabric 19 and also can be moved parallel to the direction of conveyance and also up and down. Each folding device 53 has a foundation plate 55, of which the two left foundation plates 55 in FIG. 2 are arranged stationarily on machine table 9, while the two other foundation plates 55 (to the right in FIG. 2) are arranged so that they can be adjusted and set parallel to the direction of conveyance of piece of fabric 19. It is especially notable that the four folding devices 53 are of identical construction. Each one has a holder 57 which can be moved along a guide rail 56 for the folding tongue 54. The adjustment of folding tongue 54 along guide rail 56 is executed by means of a drive motor 58 working through an endless drive chain 59, to which is fastened holder 57. The up and down movement of folding tongue 54 works a cylinder 60, which may be a pneumatic cylinder, and the back and forth movement of folding tongue 54 transverse to the direction of conveyance of piece of fabric 19 is obtained by means of a drive motor 62 working through a connecting rod assembly 61. FIGS. 4 and 11 show the movement phases of one of the four folding tongues 54 during the formation of a hem 11 on piece of fabric 19. Accordingly, folding tongue 54 (FIG. 4) is moved from a right top position at an identical height inward unitl it engages the passage 20, then perpendicularly downward until it engages the piece of fabric 19 and then at the level of piece of fabric 19 it again moves outward.

Before the four folding devices 53 form the two hems 11, in other words before folding tongues 54 undertake the movements shown in FIGS. 4 and 11, four holding devices 64 (FIGS. 8–10) acting on the extending ends 22 of elastic bands 14 are aligned on clamp carriers 33 of the third conveyor device 32. These holding devices 64 are arranged on the sewing devices 47 and are described in more detail hereinafter. After the alignment of holding devices 64 on holding clamps 33 (FIGS. 9 and 10) has been accomplished, then the hems 11 which are formed on pieces of fabric 10 are positioned in the middle of corner processing station 18 by the four folding tongues 54. Thus each two folding tongues 54 pull the fabric as shown in FIG. 4 outside to the right, and the fold 21 hanging in passage 20 becomes shorter, as is indicated at 21' in FIGS. 4 and 5. Clamp carriers 33 thus tightly hold piece of fabric 19 on cut edges 13 in the area of the corners, as shown in FIG. 4. The movements which are executed by the two folding tongues 54 on each shorter side of piece of fabric 19, in order to form hems 11, are the same type of movements, as opposed to the "in and out movement" of folding tongues 54. Folding tongues 54 remain in the position shown in FIG. 4 at the right bottom and in the positions shown in FIGS.

12–14 up until formation of the corner seam, in order to hold hems 11 stretched out, which is to be explained hereinafter.

So that problem-free corner seams 12 can be produced on fitted sheets 10 (FIG. 18), it is further necessary to align (FIG. 15) the sewing trajectories of sewing needles 49 or respectively of sewing machines 48 for corner seams 12 on the intersecting points S of elastic bands 14 or cut edges 13 with the longitudinal edges 15 of the relevant piece of fabric 19, and also to adjust the spacing A between each two sewing needles 49 on the outside edge 8 of each one of the hems 11 to the width of a bed mattress for which the fitted sheet 10 which is being manufactured is intended (FIG. 1*a*). For this purpose, the sewing machines 48 are now arranged to be rotatable around a vertical axis 65, which in turn is aligned with a sewing needle 49 (FIGS. 6 and 7). Furthermore, each sewing machine 48 is fastened by means of its drive motor 66 to a carriage 67 which can be moved back and forth along a guide rail 68. For this purpose, the carriage 67 is fastened through an attachment 69 to an endless conveyor belt 70, which runs over a guide pulley 71 and is powered by a drive motor 72, which can be rotated in either of two directions of rotation. Drive motor 72 is fastened onto guide rail 68 of which the other end is also supporting a bearing arm 74 for guide pulley 71. Guide rail 68 is supported on a vertical journal 75, which is supported by a coiler plate 76, provided with a gear rim 77. Coiler plate 76 is mounted so that it can be rotated on a bearing plate 78, which is fastened onto foundation plate 73. A pinion 79 remains in engagement with gear rim 77, and is fastened onto the drive shaft of a motor 80, which can be driven in two directions of rotation. Motor 80 is fastened onto foundation plate 73. When motor 80 is connected, therefore, guide rail 68 and with it the sewing machine 48 can be rotated by means of pinion 79 and gear rim 77, coiler plate 76 and journal 75 around the vertical axis 65 in one or the other direction. As already explained, axis 65 is aligned with sewing needle 49 of sewing machine 48.

While foundation plates 73 of both the sewing assemblies 47 on the left in FIG. 2 together with their longitudinal axes are fastened rigidly at an angle of approximately 50° to the longitudinal axis of the sewing assembly on machine table 9, foundation plates 73 of the two right sewing assemblies 47 are adjustable on guide rails 81 parallel to the longitudinal axis of the sewing assembly (direction of conveyance of pieces of fabric 19) arranged on machine table 9. Guide rails 81 are fastened to machine table 9 and a spindle 83 serves for the adjustment of each one by being rotatable by means of a manually operated wheel 82. Each spindle 83 is axially connected tightly with its foundation plate 72 and is rotary movable, but nonetheless axially secure. The same thing is true for a second shaft 85, which is power-sequentially connected through an endless drive chain 84 with spindle 83. The longitudinal axes of adjustable foundation plates 73 likewise form an angle of approximately 50° with the longitudinal axis of sewing assembly 1. The two sewing assemblies 47 on the right side of corner processing station 18 could therefore be adjusted by suitable rotation of wheels 82 parallel to the longitudinal axes of the sewing assembly, in order to be able to attain greater modifications in the widths of pieces of fabric 19. Slight variations of the widths of pieces of fabric 19 which occur during the manufacturing process, within one and the same strip of material, are nonetheless to be compensated in some other manner, as is to be explained hereinafter.

Each guide rail 68 supports another guide rail 87 by means of an arm 86 (FIGS. 6–8), along which a carriage 88 can be moved back and forth. Carriage 88 in turn carries the already described holding devices 64 for the projecting outward ends 22 of elastic bands 14. Referred to in some detail, on each carriage 88 is fastened an arm 890, which in turn carries an operating cylinder 90 (FIG. 6) which may be pneumatically operated. Each holding device 64 has two holding fingers 89, which can be moved up and down by the operating cylinder 90. The top holding finger 89 by means of an arm extending downward therefrom is connected rigidly with the piston rod of operating cylinder 90, while the bottom holding finger 89 (FIG. 6) is mounted slidably on the vertical arm extending downward from top holding finger 89, and can be moved up and down by a cylinder 91 which may be pneumatically operated, which is fastened securely to the vertical arm of the top holding finger 89. Holding fingers 89 cover an identical area in the plan view (FIG. 7) and are configured so that they can move in the space between the U-shaped clamp carriers 33, in order to grasp ends 22 of elastic bands 14 from clamp carriers 33. The longitudinal shifting movement of carriage 88 away from sewing machine 48 is executed by means of a tread roller 92 (FIG. 8) mounted on carriage 88, which cooperates with by rolling on guide rail 93, which is fastened onto foundation plate 73, and indeed parallel to the longitudinal axis of the sewing assembly or the direction of conveyance of pieces of fabric 19.

Figure 9:
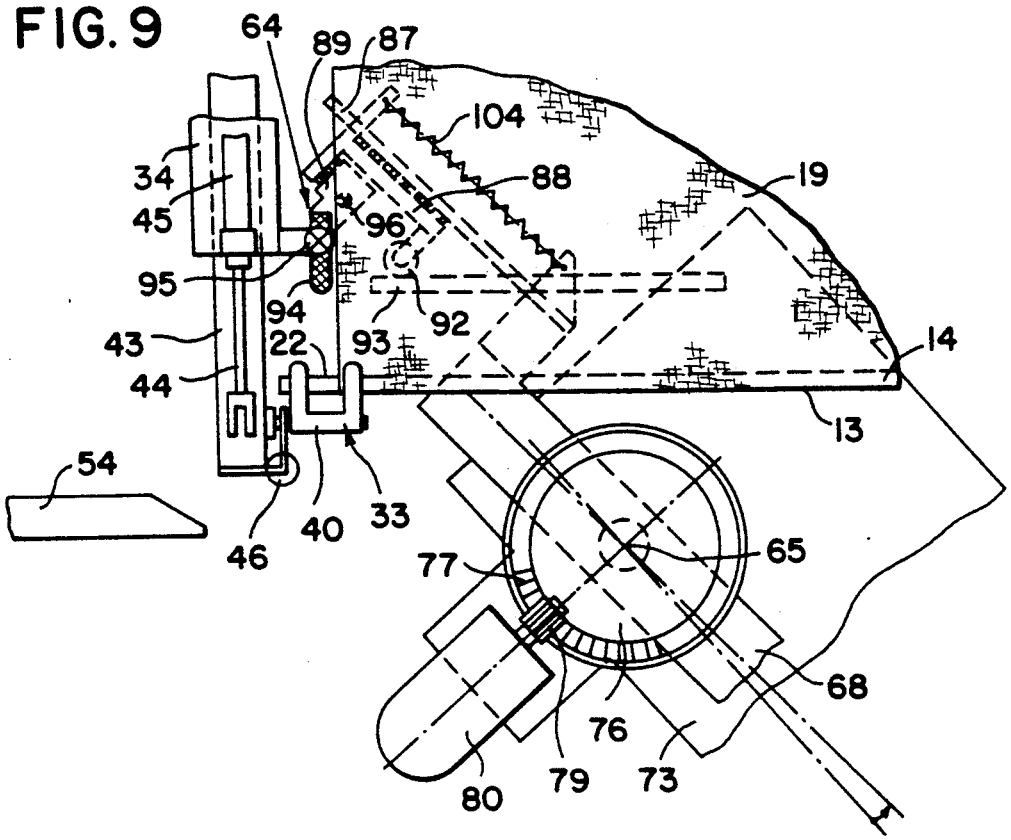
Figure 12:
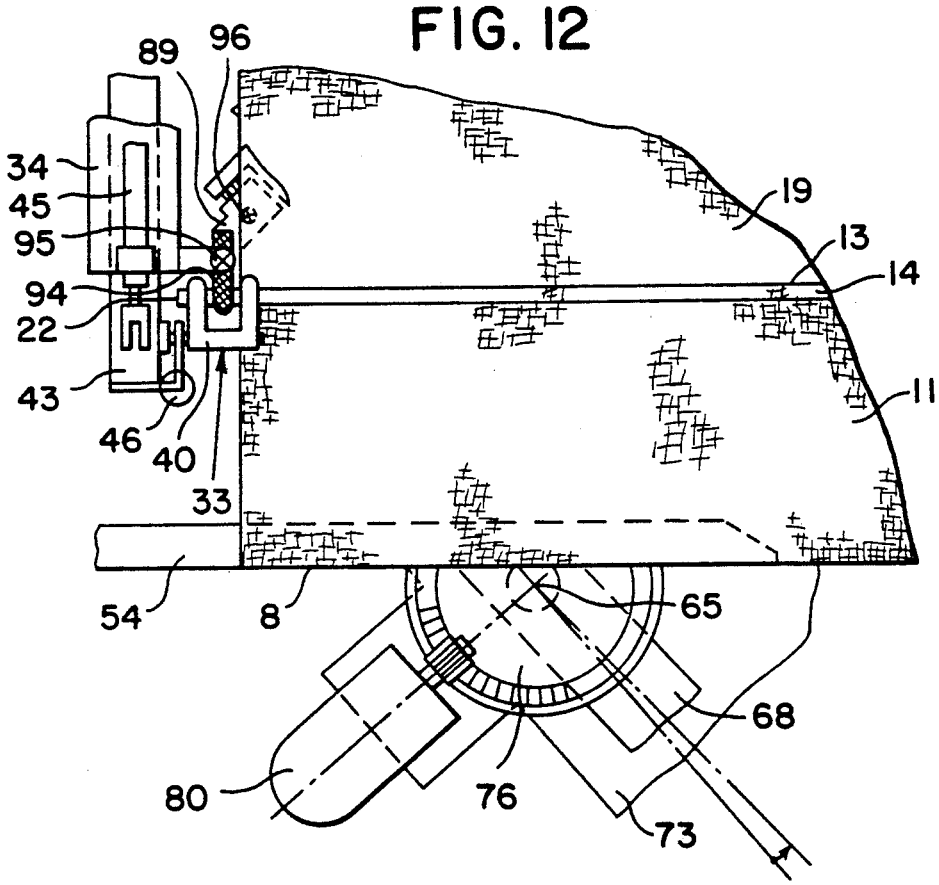

FIGS. 8 and 9 show that, with counterclockwise rotation of guide rails 68 by means of drive motor 80, carriage 88, by means of the collaborative operation of tread roller 92 with guide rail 93, is shifted outward into engagement with the end of guide rail 87, indeed counter to the force of a tension spring 104. At this point it is to be noted that the four sewing assemblies 47 are configured identically, with the exception that the two foundation plates 73 of the right sewing assemblies 47 according to FIG. 2 are adjustable parallel to the longitudinal axis of the sewing assembly. In order to pick up the extending ends 22 of elastic bands 14 and together with them the end of the piece of fabric 19 in the corner processing station 18 by the holding fingers 89, guide rails 68 are each in turn swung around the rotary axes 65 simultaneously outward until they engage the two longitudinal edges 15 of piece of fabric 19 which is positioned in corner processing station 18. Thus, carriages 88 with their two holding fingers 89 are moved simultaneously outward into the positions shown in FIGS. 9–11. The pivot movement of the four guide rails 68 or the adjustment movement of carriages 88 outward is terminated when a reflector strip 94 fastened to the top holding finger 89 comes into position to cover scanning element 95, for instance a photocell, which is being supported by carriage 34. Scanning elements 95 then disconnect drive motors 80. When this state is reached, the pairs of holding fingers 89 are moved by operating cylinder 90 out of the bottom position shown in FIG. 4 in dot-dash line upward into the position shown in FIG. 5. Now the pairs of holding fingers 890 are in turn aligned with the middle of a U-shaped clamp carrier 33. Clamp carriers 33 are now moved by their operating cylinder 45, shown in FIG. 4, to the left into the transfer position shown in FIG. 5, and this movement is executed by a not shown followup or remote control. In this transfer position the pairs of holding fingers 89 grasp the extending ends 22 of elastic bands 14 when they extend into the space between clamp carriers 33 (FIG. 12). For this purpose the operating cylinders move the holding fingers 89 which are at that moment at the bottom upward. Then clamp carriers 33 are opened by the operating cylinder 46 and carriages 34 are moved back into interim station 17, in which clamp carriers 33 grasp or carry over a new piece of fabric 19. The four pairs of holding fingers 89 now tightly hold ends 22 of elastic bands 14 and thus also hold both of the hems 11, and folding tongues 54 are still located in the position shown in FIG. 14, in order to hold hems 11 stretched out (cf. also FIG. 5).

Figure 14:
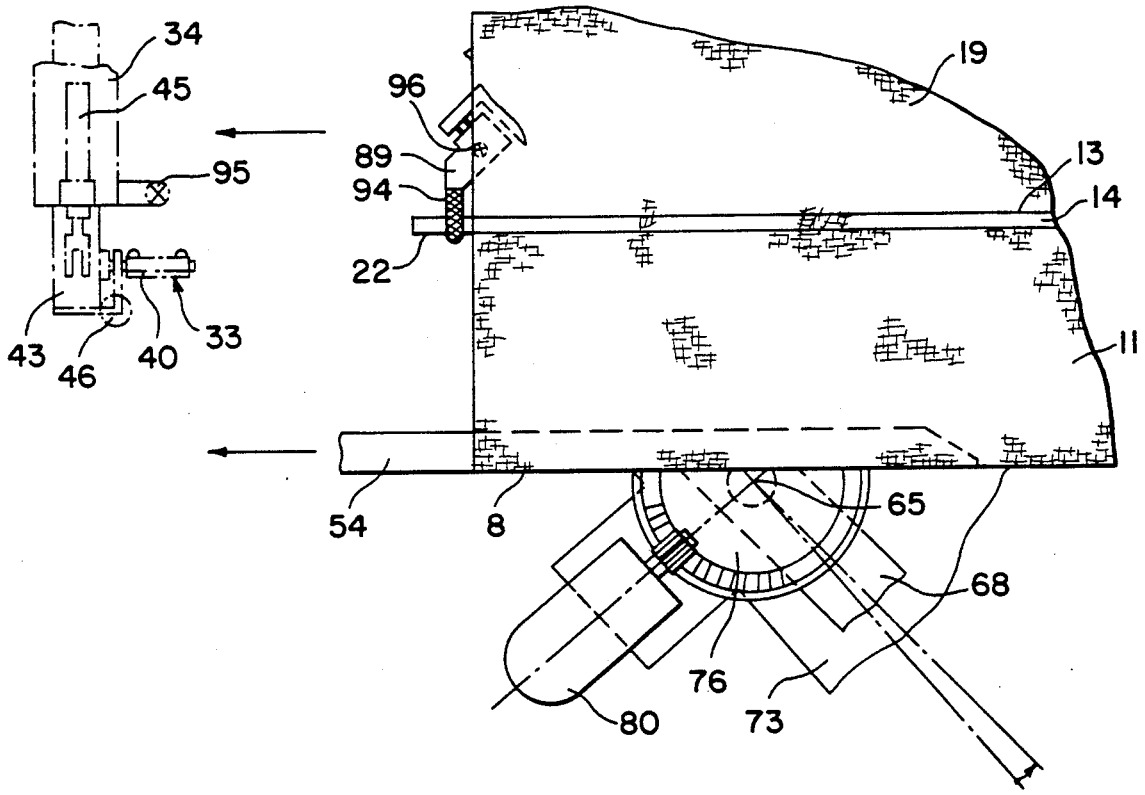

Drive motors 80 are hence reconnected by means of not shown remote control, so that guide rails 68 can be pivoted slightly as shown in FIGS. 14 and 15 still further counterclockwise. To each top holding finger 89 is fastened a scanning element 96, for instance a photocell, and said elements scan or sense the longitudinal edges 15 of each piece of fabric 19 positioned in the corner processing station 18. The arrangement is designed so that these scanning elements 96 are almost always, in other words even in terms of the smallest width of any piece of fabric, located beneath a piece of fabric 19 positioned in station 18. As soon as scanning elements 96 establish the location of longitudinal edges 15 of piece of fabric 19, they disconnect drive motors 80 and connect drive motors 72. When indeed scanning elements 96 arrive beneath longitudinal edges 15 of the piece of fabric 19 positioned in station 18, it is guaranteed that the sewing trajectories of sewing needles 49 of the four sewing assemblies 47 are aligned with the points of intersection S (FIG. 15) between cut edges 13 and longitudinal edges 14 of the relevant piece of fabric 19. The connected drive motors 72 now move carriages 67 with the likewise activated sewing machines 48, moving them outward until they engage longitudinal edges 14 of piece of fabric 19, and the four corner seams 12 (FIG. 18) are formed without any difficulty.

When a piece of fabric of width $B_2$ (FIG. 1B) is smaller than the predetermined correct fabric width $B_1$, and thus is calculated to be in the minus range, then the sewing trajectories are set automatically at the correct angle of for instance 48° with the outside edges 8 of hems 11, so that even in this case the sewing trajectories and therewith the corner seams which are being produced are aligned with the points of intersection S of cut edges 13 with longitudinal edges 15 of the relevant piece of fabric 19.

When on the other hand a slight excess width $B_3$ of piece of fabric 19 is measured (FIG. 1C), then the sewing trajectories are automatically set at an angle of 43° with the outside edges 8 of hems 11. The result is that even here the totally completed corner seams are aligned with points of intersection S of cut edges 13 with longitudinal edges 15 of the relevant piece of fabric 19.

Figure 10:
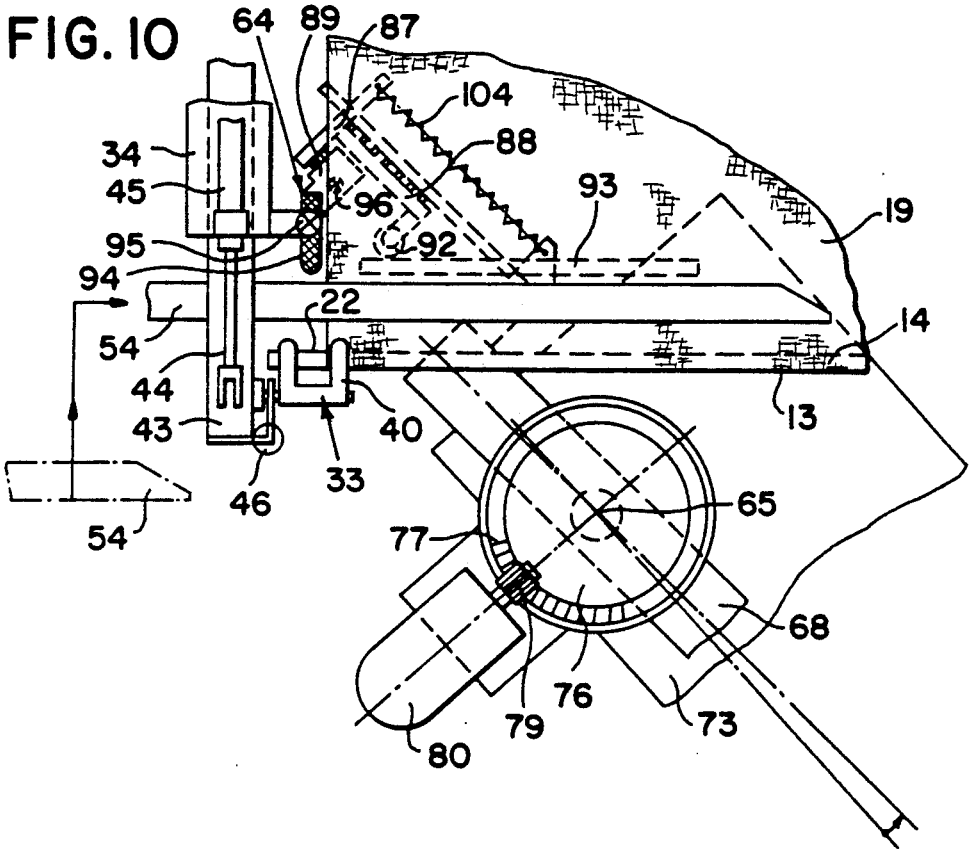
Figure 13:
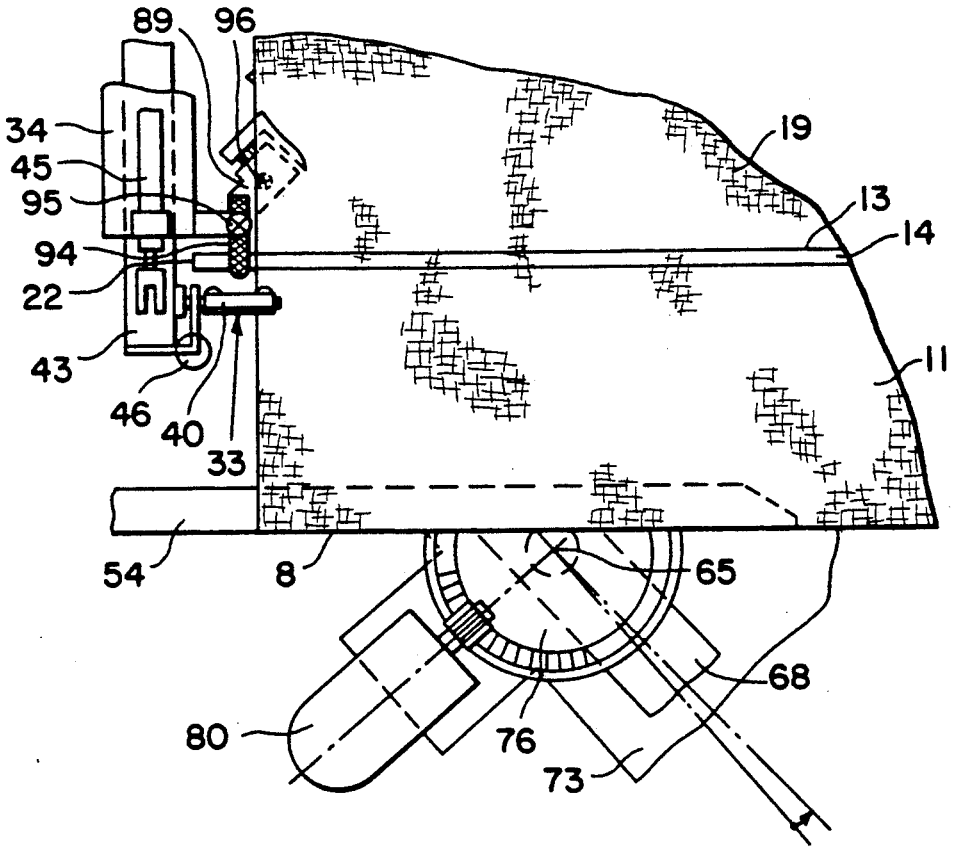

FIG. 9 shows the control and monitoring of the pairs of holding fingers 89 of each sewing device 47, aligned with the middle of clamp carriers 33 of the third conveyor device 32. FIG. 10 shows the introduction of a folding tongue 54 for the purpose of formation of a hem 11. The completely laid-out hem 11 is shown in FIG. 11. Folding tongues 54 in this phase are still located in their outermost bottom edge position (FIG. 4). In FIG. 12, holding fingers 89 grasp the ends 22 of elastic bands 14 and thus also each hem 11. This same state is also shown in FIG. 5. For this purpose, as already noted, until it comes into contact with the already raised up top holding finger 89, the bottom holding finger 89 of each arrangement 47 is moved upward by operating cylinder 91. Clamp carriers 33 are opened as shown in FIG. 13 by suitable circuitry of their operating cylinder 46 and then, as already noted, clamp carriers 33 are moved back into interim station 17, in order to pick up a new piece of fabric 19 from the second conveyor device 29.

Before the formation of corner seams 12 (FIG. 18), folding tongues 54 are moved back into their original positions shown in FIG. 2, which is also indicated in FIG. 14. FIG. 15, however, shows the state of the procedure in which the activated sewing machines 48 are being moved until they come into contact with the longitudinal edges 15 of the relevant piece of fabric 19, in order to build the four corner seams 12 (FIG. 16). FIG. 16 shows the position of one of the four sewing machines 48 following completion of the corner seam 12, wherein under the tension maintained during production of these corner seams 12, the excess corners 105 are separated simultaneously. FIG. 17 shows the completed corner seam 12 with separated corners 105, which is still held by two holding fingers 89, together with the original extending elastic band ends 22. Carriages 67 with their sewing machines 48 are moved back again into their original positions shown in FIGS. 2 and 15, and tension springs 104 simultaneously move carriages 88 with holding fingers 89 back into their original positions. Holding fingers 89 are thus opened, in order to release parts 22 and 105, which then for instance can be removed by suction. Holding fingers 89 are likewise moved back into their original positions.

FIG. 18 shows the completed corner seam 12 on the henceforth completed fitted sheet 10. In this manner, the four corner seams 12 on each fitted sheet 10 are constructed simultaneously by the four sewing assemblies 47 and the excess material corners 105 are separated and removed.

The fitted sheet 10 which is finished and now lying loose on machine table 9 in station 18 is then ejected or discharge downward by a discharge fillet 100 which can be moved up and down (FIG. 2) through the passage 20 provided in machine table 9 in and out of corner processing station 18, and fitted sheet 10 drops onto a conveyor installation 101, which transports the completed fitted sheets 10 away to the side. Discharge fillet 100 can be moved up and down for this purpose by two operating cylinders 102, which are mounted on the machine frame (not shown).

Drive motors or operating cylinders of the various assemblies of the sewing installations, insofar as they are not connected through the described scanning elements, are connected and disconnected by traditional but not shown remote control systems.

We claim:

1. In a process for the production of protective covers for bed mattresses, wherein rectangular pieces of fabric having widths are cut from strips of material and then elastic bands are sewn to the facing cut edges of piece of fabric as said fabric moved in a transport direction, the elastic bands having lengths that are approximately identical to the widths of the pieces of fabric, and then corner seams are formed on the protective covers and excess fabric corner portions are separated off, the improvement comprising the steps of:

a) measuring the widths of the pieces of fabric, b) dependent upon the results of the measurements according to step (a), positioning each of the pieces of fabric in centered relation to sewing needles of two sewing devices for sewing the corner seams adjacent to each cut edge of the piece of fabric, c) hemming the piece of fabric substantially parallel to said cut edges and attaching the hemmed parts of the piece of fabric together, d) adjusting the spacing of the sewing needles of the two sewing devices for sewing the corner seams at an outside edge of each of the hems of the piece of fabric to approximate a width of a bed mattress, e) scanning two longitudinal edges of a positioned piece of fabric, and dependent upon the measurements resulting from the scanning, adjusting the sewing needles of the sewing devices in such a way as to move said needles through a trajectory for the formation of the corner seams at the points of intersection of the elastic bands with the longitudinal edges of the piece of fabric, and f) forming the corner seams along the adjusted sewing trajectories, and separating the excess fabric corners adjacent to each corner seam.

2. Method as in claim 1, wherein before the positioning of the sewing needles of the sewing devices for formation of the corner seams at the points of intersection of the elastic bands with the longitudinal edges of the piece of fabric, a rough adjustment of the sewing trajectories occurs at an angle in the range of approximately 45° to 50° in relation to the cut edges of a piece of fabric.

3. Method as in claim 1, wherein the width of the piece of fabric is measured while said piece of fabric is being conveyed in the transport direction, and means are provided to hold said piece of fabric in a stretched-out state while said piece is being measured.

4. Method as in claim 1, wherein a completed protective cover discharged downwardly from the transport direction and then is transported away to a side of the sewing devices.

5. Sewing apparatus for the production of protective covers for bed mattresses, said sewing apparatus having an interim station and a corner processing station, and comprising:

a) a first conveyor device (23) for conveying rectangular pieces of fabric (19) cut off from a strip of material, said first conveyor device conveys a piece of fabric (19) transversely to a lengthwise dimension of the fabric and parallel to two cut edges (13) to the interim station (17), b) feed devices (25, 26) for elastic bands (14) facing the two cut edges (13) of the piece of fabric (19) in an area of the first conveyor device (23), said feed devices guide the elastic bands (14) in a stretched-out state parallel to the two cut edges (13) of each piece of fabric (19) until the bands engage with the cut edges (13), c) two sewing machines (27) in the area of the first conveyor device (23) for sewing the elastic bands (14) being under tension parallel to the edges of the piece of fabric (19) with the formation of projecting edges (22) of said sewn elastic bands located along each of a longitudinal edge (15) of the piece of fabric (19), d) a second conveyor device (29) at the interim station (17), for engaging the piece of fabric (19) from the first conveyor device (23), e) a third conveyor device (32), for engaging the piece of fabric (19) from the second conveyor device (29) at the interim station (17) and conveying the piece of fabric to the corner processing station (18), f) a measuring device (50, 51) for measurement of the widths of the pieces of fabric (19), said measurement controls the third conveyor device (32) in such a manner that said third conveyor device centers and positions each piece of fabric (19) in the corner processing station (18), g) two sewing assemblies (47) located at the corner processing station (18) opposite to each cut edge (13) of the piece of fabric (19) said sewing assemblies are both arranged and designed to be movable around an axis of sewing needles (49) comprised by said sewing assemblies, and the sewing machines (48) of the sewing assemblies are movable in the direction of sewing of the seam, h) devices (53) at the corner processing station (18) for formation of two hems (11) on each piece of fabric (19) parallel to the cut edges (13) of the fabric, i) holding devices (64) located at the corner processing station (18) to hold the projecting ends (22) of the elastic bands (14) sewn to the hems of each of the pieces of fabric (19), said holding devices engaging the projecting ends (22) of the elastic bands (14) conveyed by the third conveyor device (32), j) scanning and control devices (96) at the corner processing station (18), said scanning devices scan and sense the longitudinal edges (15) of each of the pieces of fabric (19) and then said control devices control and adjust the movements of the sewing devices (47) for their adjustment in such a manner that sewing trajectories of the sewing machines are aligned at points of intersection (S) of the elastic bands (14) (13) with the longitudinal edges (15) of each of the pieces of fabric (19), and a reciprocal spacing (A) of the sewing needles (49) of each two sewing assemblies (47) is adjustable on an outside edge (8) of the hems (11) of each of the pieces of fabric (19) to approximate a width of a bed mattress, k) separating devices at the corner processing station (18) for the separation of the excess fabric corner portions (105) from the protective covers (10), and l) a fourth conveyor device (100, 101) for the transport of the completed protective covers (10) from the corner processing station (18).

6. Sewing assembly as in claim 5, wherein the second conveyor device (29) at the interim station (17) is configured to be moved up and down and the third conveyor device (32) has four clamp carriers (33) for the pieces of fabric (19), the clamp carriers (33) being movable along guide rails (35) in the transport direction of the piece of fabric (19), as well as transverse to the transport direction.

7. Sewing assembly as in claim 6, wherein the clamp carriers (33) are configured to be U-shaped in a planar view and the holding devices (64) for the projecting ends (22) of the elastic bands (14) have four pairs of holding fingers (89) movable up and down, and movable into a space in the U-shaped clamp carriers (33), in order to pick up the projecting ends (22) of the elastic bands (14).

8. Sewing assembly as in claim 7, wherein the scanning element (96) is arranged on one of the holding fingers (89) of one of the pairs of holding fingers for the projecting ends (22) of the elastic bands (14).

9. Sewing assembly as in claim 5, wherein the measuring device for measuring the widths of the pieces of fabric (19) includes two measuring the widths of the pieces of fabric (19) includes two measuring members (50, 51), one measuring member (50) being arranged between the interim station (17) and the corner processing station (18) and the other measuring member (51) being located at the corner processing station (18) between connection lines (52) of the sewing needles (49) of each two sewing assemblies (47), running transverse to the transport direction of the pieces of fabric, and the first measuring member (50) measures the width of the pieces of fabric (19) and the second measuring member (51) measures each piece of fabric (19) running into the corner processing station (18) and controls the third conveyor device (32) to position each piece of fabric (19) in the corner processing station (18).

10. Sewing assembly as in claim 5, wherein at least two sewing assemblies (47) are arranged adjustably parallel to the transport direction of the pieces of fabric (19).

11. Sewing assembly as in claim 5, wherein each sewing assembly (47) includes a sewing machine (48) supported by a carriage (67) movable along at least one guide rail (68) arranged on a motor-powered coiler plate (76) driven by means of a pinion (79) and ring gear (77), and that the guide rail (68) in turn supports a scanning element (96) of the scanning and control devices to control the movement of the sewing assemblies (47) for their adjustment.

12. Sewing assembly as in claim 11, wherein the scanning elements (96) of the control devices for scanning and controlling the movements of the sewing devices (47) for their adjustment, in each case are arranged on one of the holding fingers (89) of one of the pairs of holding fingers for the projecting ends (22) of the elastic bands (14).

13. Sewing assembly as in claim 11, wherein on each guide rail (68) is arranged an additional carriage (88) movable thereon and supporting said pair of holding fingers, said holding fingers grasp the projecting ends (22) of the elastic bands (14), one of the holding fingers (89) of each pair of holding fingers cooperating with a scanning element (95), and the scanning element (95) being carried by the third conveyor device (32) for the transfer of the elastic bands (14) from the clamp carriers (33) of the third conveyor device (32) to the pairs of holding fingers (89).

14. Sewing assembly as in claim 5, wherein on each guide rail (68) is arranged an additional carriage (88) movable thereon and supporting said pair of holding fingers, said holding fingers grasp the projecting ends (22) of the elastic bands (14), one of the holding fingers (89) of each pair of holding fingers cooperating with a scanning element (95), and the scanning element (95) being carried by the third conveyor device (32) for the transfer of the elastic bands (14) from the clamp carriers (33) of the third conveyor device (32) to the pairs of holding fingers (89).

15. Sewing assembly as in claim 5, wherein the fourth conveyor device (100, 101) for transporting away the completed protective covers (10) has a discharge fillet (100) movable up and down, extending from a middle transversely over each protective cover (10) at the corner processing station (18), and each protective cover (10) is discharged downward over fillet (100) through a passage (20) provided in a machine table (9), and beneath the machine table (9) is arranged a conveyor installation (101) to collect the protective covers and to transport them away.

* * * * *